US008235757B2

(12) United States Patent
Brear

(10) Patent No.: US 8,235,757 B2
(45) Date of Patent: Aug. 7, 2012

(54) PLUG

(75) Inventor: Malcolm Bruce Brear, Empire Bay (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/641,367

(22) Filed: Dec. 18, 2009

(65) Prior Publication Data

US 2010/0159736 A1 Jun. 24, 2010

(30) Foreign Application Priority Data

Dec. 19, 2008 (AU) ..... 2008906544

(51) Int. Cl.
*H01R 24/00* (2006.01)

(52) U.S. Cl. ..... 439/676; 439/76.1

(58) Field of Classification Search ..... 439/76.1, 439/404, 676, 941
See application file for complete search history.

(56) References Cited

U.S. PATENT DOCUMENTS 5,911,594 A * 6/1999 Baker et al. ..... 439/404
6,270,358 B1 * 8/2001 Nozick ..... 439/76.1
6,338,643 B1 * 1/2002 Miller et al. ..... 439/417
6,354,872 B1 * 3/2002 Lilienthal et al. ..... 439/578
6,561,838 B1 5/2003 Blichfeldt
6,746,283 B2 * 6/2004 Arnett et al. ..... 439/676
6,830,488 B2 12/2004 Bush et al.
7,249,962 B2 * 7/2007 Milette et al. ..... 439/425
7,401,402 B2 7/2008 Bresche et al.
7,559,790 B2 * 7/2009 Boeck et al. ..... 439/409
7,604,515 B2 * 10/2009 Siemon et al. ..... 439/676
7,695,307 B2 4/2010 Mossner et al.

* cited by examiner

*Primary Examiner* — Thanh Tam Le

(74) *Attorney, Agent, or Firm* — Merchant & Gould P.C.

(57) ABSTRACT

An electrical connector for terminating a cable formed of twisted pairs, including a termination assembly having a divider for dividing and guiding the pairs to a respective termination location and a pair of contacts positioned adjacent each location where wires of each pair are separated for termination. The electrical connector is preferably an RJ plug and the divider is preferably mounted on a printed circuit board which is provided with a laser trimmed tuneable circuit to compensate for crosstalk.

17 Claims, 3 Drawing Sheets

PLUG

This application claims benefit of Serial No. 2008906544, filed 19 Dec. 2008 in Australia and which application is incorporated herein by reference. To the extent appropriate, a claim of priority is made to the above disclosed applications.

FIELD OF THE INVENTION

The present invention relates to a plug such as an RJ plug.

BACKGROUND OF THE INVENTION

A patch cable or patch cord is an electrical cable used to connect one electrical device to another. A category 6 cable, commonly known as a Cat 6, is a twisted pair cable type designed for high signal integrity, such as for use in computer networks.

Category 6 cable includes four twisted pairs in a single cable jacket. The twisted pairs are terminated in a connection plug which may in turn be received in an RJ socket, for example, for connection into a network.

The twisted pairs are manually terminated by an operator by firstly being separated into individual wires which are aligned with and laid in parallel channels formed in the plug. The wires are electrically connected to pin of the plug which ultimately connect with contacts within the socket.

The wires generally need to be gripped tightly when the group of eight wires are positioned in the plug prior to termination and this can lead to repetitive strain injuries.

Also, managing the group of eight wires simultaneously can cause some of the wires to be misaligned with the designated channel, which may present difficulties for the operator in realigning some of the wires while holding the others in place. It may be necessary to cut the plug free from the cable and start the termination process again, especially if some of the wires have already been terminated, if the handling becomes too difficult.

Since the wires are organised as a group of eight parallel wires, it may be desirable, prior to gripping the eight wires, to manually introduce some twists or cross-overs just prior to termination as a way of reducing cross talk between adjacent pairs of wires. However, manual manipulation is prone to error and, if a strict wire arrangement is not complied with, performance of the plug can be diminished.

Once the wires are terminated in the above manner, it is extremely difficult to manually tweak the performance of the plug.

Additionally, to produce a test plug, the wires are organised as a group of eight parallel wires (near the IDC end), which then need to be tuned manually by manipulation of the wires position relationships by introducing some twists or cross overs just prior to termination.

This process requires delicate trial-and-error terminations, in order to determine an optimal relationship between the wires in a move and test process which has many combination variables and differences. The process essentially needs to be repeated until the technician encounters what is considered an optimal arrangement that meets the required calibration and this takes considerable time, in the order of days, to complete.

SUMMARY OF THE INVENTION

The present invention seeks to provide an alternative plug and/or method of construction.

In accordance with the invention, there is provided a plug for terminating a cable formed of twisted pairs, the plug having a termination assembly including contacts for electrical connection with the wires and a tuning circuit coupled to the contacts and adapted for laser trimming to enhance cross-talk performance of the plug.

Preferably, the termination assembly includes a printed circuit board which carries the tuning circuit.

Preferably, the contacts are insulation displacement contacts (IDCs) mounted to the board.

Preferably, the plug includes a divider which divides the twisted pairs out from the cable and guides the pairs along separate pathways, each pathway leading to a respective termination location where the wires are separated adjacent associated contacts for termination therewith.

Preferably, the divider is formed of a plastic block mounted over the contacts and onto the printed circuit board.

In another aspect, there is provided a divider for use in the above-described plug, wherein the divider includes an entry port for receipt of a cable formed of twisted wire pairs, channels for guiding the twisted pairs divided from the cable along separate pathways to respective termination locations where the wires are adapted to be terminated, the divider being adapted to receive contacts adjacent the locations for electrical connection with separated wires of the twisted pairs.

In another aspect, there is provided an electrical connector for terminating a cable formed of twisted pairs, including a termination assembly having a divider for dividing and guiding the pairs to a respective termination location and a pair of contacts positioned adjacent each location where wires of each pair are separated for termination.

Preferably, the contacts are positioned about the respective locations so as to minimize a distance over which the wires are separated.

Preferably, the twisted pairs are guided along separate pathways and the contacts are angularly offset about the location with respect to a direction of the respective pathway.

Preferably, the locations are spaced apart to reduce cross-talk and/or interference between wires separated from each twisted pair.

Preferably, the divider is in the form of a plastic block mounted on a printed circuit board.

Preferably, the block includes apertures through which the contacts extend to provide electrical connection between the printed circuit board and the wires of the cable.

Preferably, the printed circuit board carries a timing circuit for compensating cross-talk between wires of the cable.

In another aspect, there is provided a method of terminating a cable in a plug, as described above, including separating twisted pairs from the cable and providing the pairs along the pathways of the divider, separating the wires of each pair and terminating the wires at the contacts.

Preferably, the wires are automatically trimmed as they are terminated.

Preferably, the method includes loading the termination assembly into a plug housing and over-molding the plug housing.

Preferably, the method includes molding a support boot onto the plug.

Alternatively, the method includes loading the termination assembly into a plug housing and fitting a cap molding that terminates the wires when fitted to the plug housing.

BRIEF DESCRIPTION OF THE DRAWINGS

The invention is described, by way of non-limiting example only, with reference to the accompanying drawings, in which.

DETAILED DESCRIPTION OF THE DRAWINGS

Figure 1:
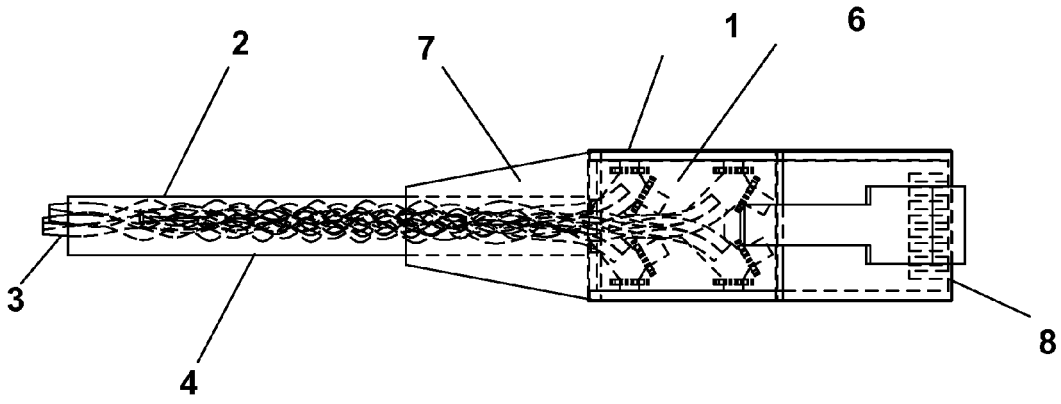
FIG. 1 is a top view of a plug.
Figure 2:
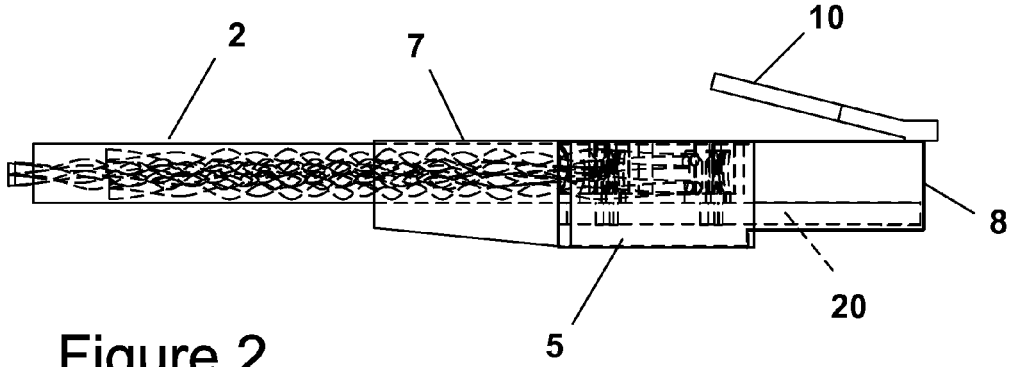
FIG. 2 is a side view of the plug of FIG. 1.
Figure 3:
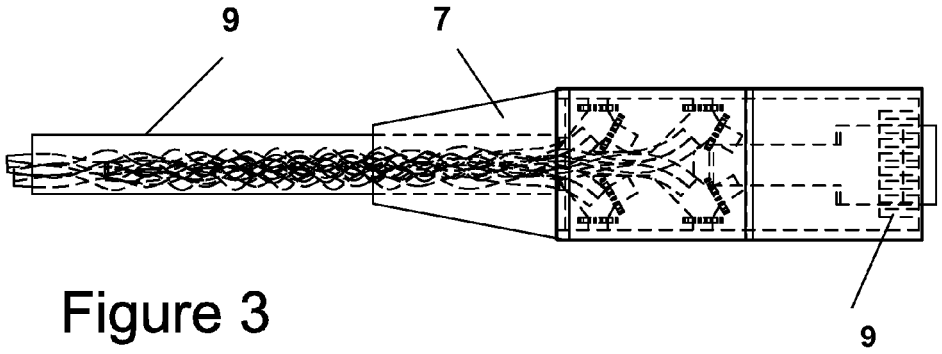
FIG. 3 is a bottom view of the plug.

Referring firstly to FIGS. 1 to 3, an electrical connector in the form of a plug 1 is shown attached to a cable 2 which is formed of four twisted wire pairs 3 within a cable jacket 4.

The plug 1 includes a plug housing 5, an over-molding 6 and a molded boot 7, a front end 8 of the plug 1 is adapted to be received within a socket (not shown) so that conductor pads 9 of the plug 1 electrically connect with associated contacts of the socket. A clip 10 is provided to releasably secure the plug 1 within the socket.

A termination assembly 20 is mounted within the plug housing 5 to provide electrical connection between the pads 9 and the twisted wire pairs 3 of the cable 2.

Figure 4:
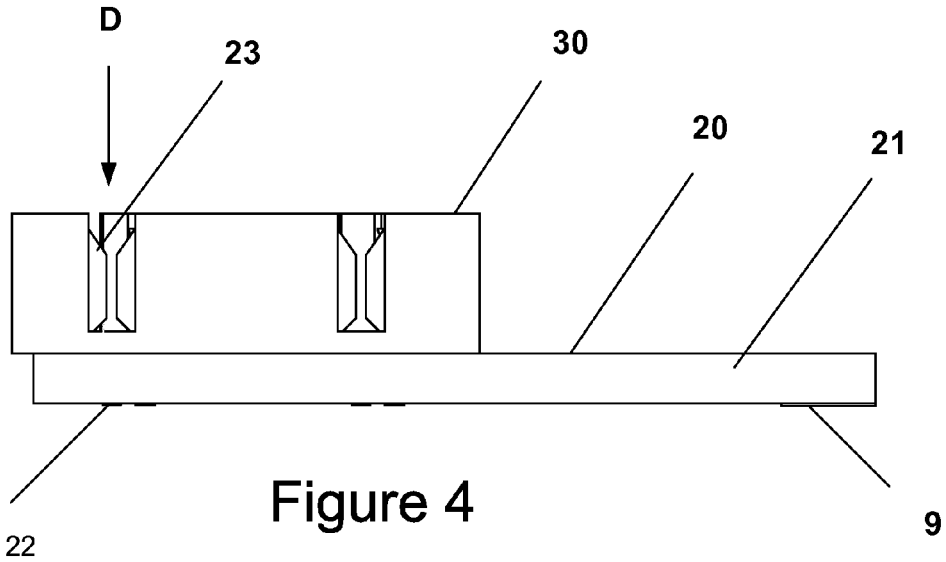
FIG. 4 is a side view of a termination assembly of the plug.
Figure 5:
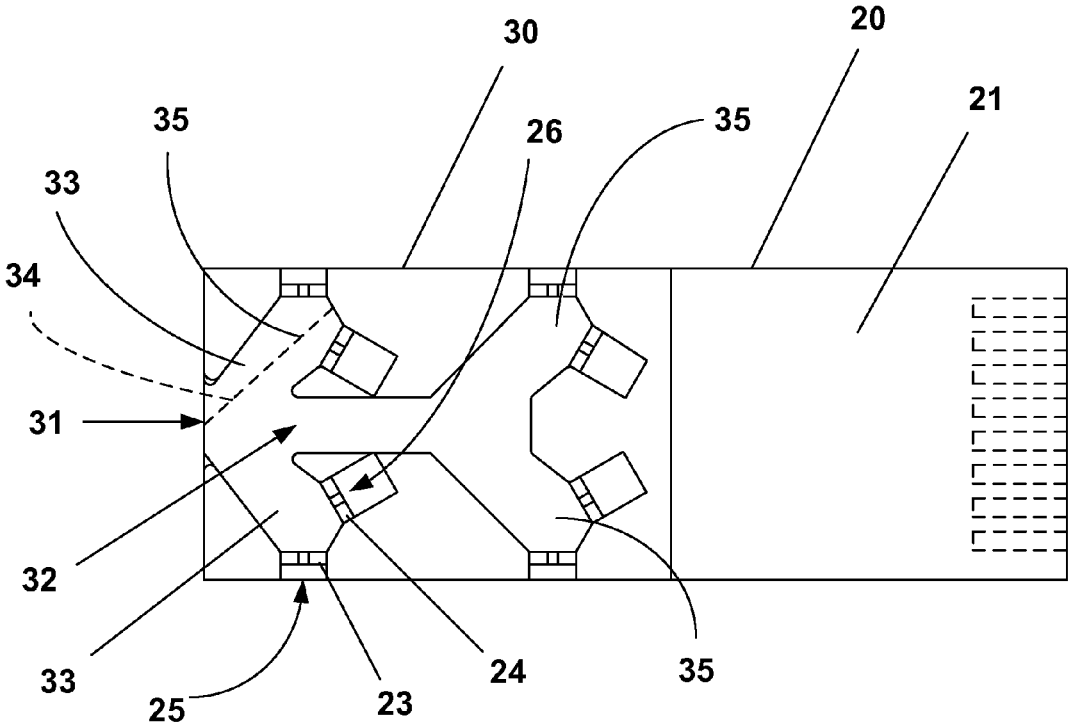
FIG. 5 is a top view of the termination assembly.
Figure 6:
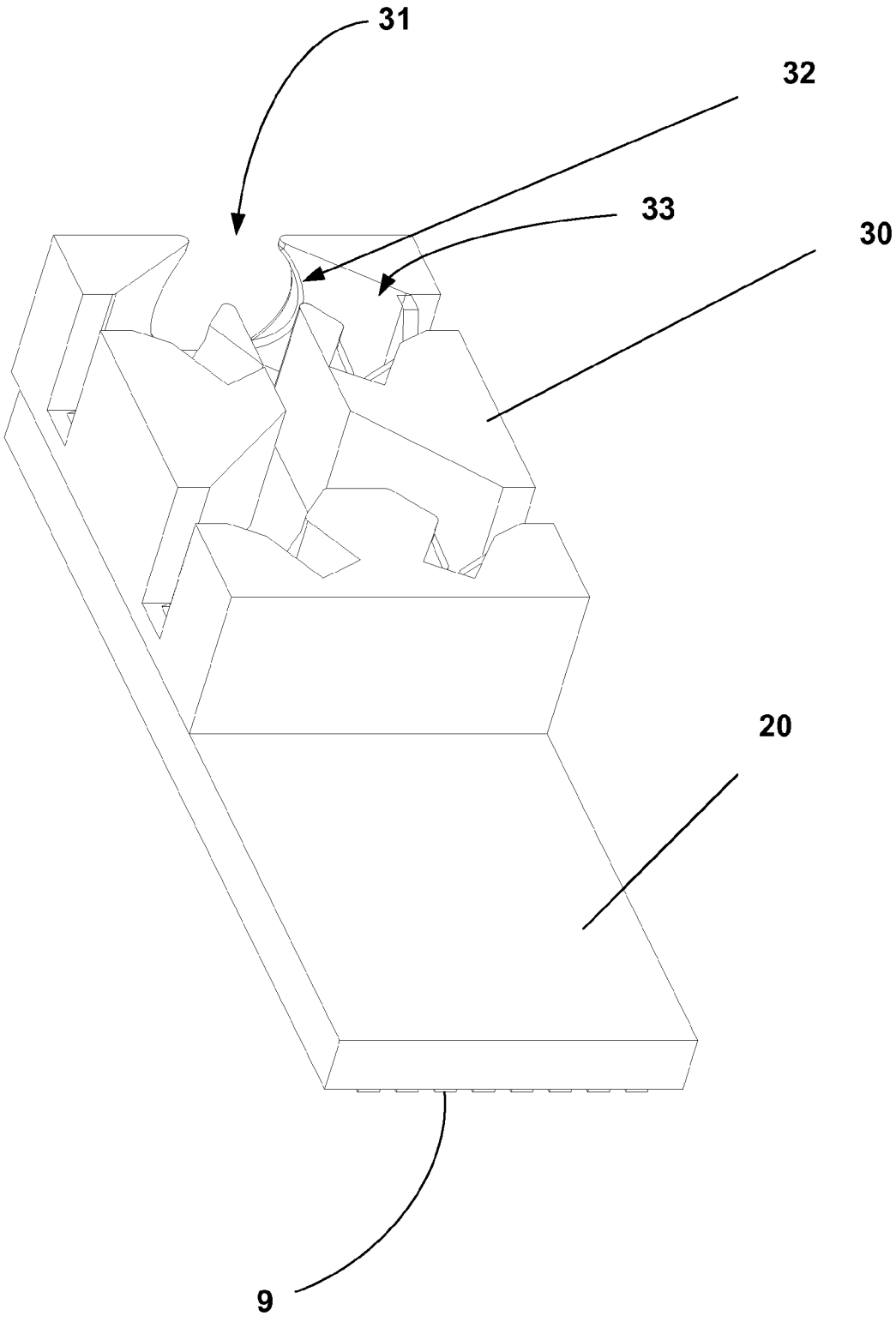
FIG. 6 is a perspective view of the termination assembly.

The termination assembly 20 is shown more clearly in FIGS. 4 to 6 as including a printed circuit board (PCB) 21 which carries the conductor pads 9 and printed circuit (not shown) which interconnects each pad 9 with an associated contact point 22. Each contact point 22 is in turn electrically connected with a respective one of a pair of insulation displacement contacts 23, 24, which extend through the printed circuit board 21. The printed circuit which connects the pads 9 to contacts 22 is preferably designed, in known manner, to traverse the PCB in such a way that cross talk between adjacent wire pairs 3, which connect with the respective contacts 23, 24, is reduced.

Each pair of contacts 23, 24 projects away from the circuit board 21 and is housed in an associated insertion slot 25, 26 formed in a cable divider 30, which is mounted onto the circuit board 21.

The divider 30 defines an inlet aperture 31 which communicates with a main channel 32 which has side branches 33 arranged to define separate pathways 34 for individual twisted pairs 3 of the cable 2. Each pathway 34 ends at a termination location 35 immediately adjacent the pair of contacts 23, 24 at which location 35 the twisted pair is separated into individual wires which are then terminated by being pressed into the respective insulation displacement contact in a direction "D".

The contacts 23, 24 are preferably arranged to be angularly offset from the pathway 34 in order to align with the respective wires immediately upon the wires being untwisted. As such, the distance over which the wires are untwisted is minimal so as to minimize the potential for cross-talk therebetween. The termination locations 35 are also spaced apart to again minimize any cross-talk or interference between the respective twisted pairs.

Part of the printed circuit provided on the circuit board allows for tuning of the plug 1 via laser trimming, effected by laser burning sacrificial tuning capacitor tracks. Such tuneable circuits are known to be used in relation to sockets. See for example U.S. Pat. No. 7,401,402. The specific design of the printed circuit is considered within the expertise of a person skilled in the art and no further details need be provided in this instance. It should, however, be noted a plug provided with tracks that are tuneable via laser trimming may allow for large scale production of RJ plugs with high performance suitable for either Cat 6 or Cat 6a and 10 gig jack requirements.

In order to assemble the plug 1, the assembly 20 may firstly be mounted in the plug housing 5 and the cable 2 inserted into the aperture 31 and divided whereby each twisted pair is laid out along an associated branch 33 of the main channel 32 to extend along a respective pathway 34. The twisted pairs are then untwisted at the respective termination location 35 and engaged with the insulation displacement contacts 23, 24 using a tool which simultaneously also trims the ends of the wires. An overmolding and molded boot 7 may then be formed over the plug housing 5 in order to complete the construction of the plug.

Alternatively, the wires may be untwisted at the termination locations, as described above, and terminated using a cap 6 which effectively serves to force the wires into the insulation displacement contacts 23, 24, so as to terminate the wires, whilst at the same time serving to cap the termination assembly 20, without requiring any additional overmolding.

As may be appreciated from the above, whichever method of construction is adopted, the twist of the wire pairs in the plug 1 is maintained up to immediately adjacent the contacts 23, 24, and this provides an advantage in so far as cross-talk and interference is minimized. The design of the plug 1 also allows for automated termination of the wires of the cable 2 which assists in removing a considerable amount of manual labour and associated repetitive strain injuries that existed with manufacture of a conventional RJ plug.

The laser tuning feature can also be used to enhance signal integrity performance of the plug as well as simplifying the manufacture of de-embedded test plugs for test laboratories used for testing networks, RJ 45 jacks and related developments. A test plug may be manufactured in a number of hours instead of days.

Lastly, the invention allows for a reduction in assembly costs of patch cords and RJ plug terminated cable assemblies in which the plug 1 is an integral part. Although RJ plugs are specifically referred to, the invention has application to other forms of lugs or electrical connector.

The invention has been described by non-limiting example only and many modifications and variations may be made without departing from the spirit and scope of the invention described.

| LIST OF PARTS |
|---|
| 1. Plug |
| 2. Cable |
| 3. Twisted wire pairs |
| 4. Cable jacket |
| 5. Housing |
| 6. Over-molding |
| 7. Molded boot |
| 8. Front end |
| 9. Conductor pads |
| 10. Clip |
| 20. Termination assembly |
| 21. Printed circuit board |
| 22. Contact point |
| 23. Contact |
| 24. Contact |
| 25. Insertion slot |
| 26. Insertion slot |
| 30. Divider |
| 31. Inlet aperture |
| 32. Main channel |
| 33. Side branch |
| 34. Pathway |
| 35. Termination location |

The claims defining the invention are as follows:

1. A plug for terminating a cable formed of twisted pairs of wires, the plug comprising:

a termination assembly including contacts for electrical connection with the wires and a tuning circuit coupled to the contacts and adapted for laser trimming to enhance cross-talk performance of the plug;

wherein the plug includes a divider which divides the twisted pairs out from the cable and guides the pairs along separate pathways, each pathway leading to a respective termination location where the wires are separated and routed in to associated contacts for termination therewith, the associated contacts being angularly offset from the respective pathway.

2. The plug of claim 1, wherein the termination assembly includes a printed circuit board which carries the tuning circuit.

3. The plug of claim 2, wherein the contacts are insulation displacement contacts (IDCs) mounted to the board.

4. The plug of claim 2, wherein the divider is formed of a plastic block mounted over the contacts and onto the printed circuit board.

5. A divider for use in a plug for terminating a cable formed of twisted pairs of wires, the plug having a termination assembly including contacts for electrical connection with the wires and a tuning circuit coupled to the contacts and adapted for laser trimming to enhance cross-talk performance of the plug, the divider comprising:

an entry port for receipt of the cable formed of twisted wire pairs, channels for guiding the twisted pairs divided from the cable along separate pathways to respective termination locations where the wires of the twisted pair are adapted to be terminated, wherein the pathways do not all split at a common branch point, and the divider being adapted to receive the contacts adjacent the locations for electrical connection with separated wires of the twisted pairs.

6. An electrical plug connector for terminating a cable formed of twisted pairs of wires, comprising:

a plug housing adapted to be received within a socket; and a termination assembly located in the plug housing, the termination assembly having a divider including a main channel which has side branches arranged to divide the twisted pairs out from the cable along separate pathways, each pathway leading to a respective termination location where the wires are separated adjacent associated contacts for termination therewith, wherein at least some contacts at the termination locations face in a different direction from other contacts at the termination locations.

7. The connector of claim 6, wherein the contacts are positioned about the respective locations so as to minimize a distance over which the wires are separated.

8. The connector of claim 6, wherein the twisted pairs are guided along separate pathways and the contacts are angularly offset about the location with respect to a direction of the respective pathway.

9. The connector of claim 6, wherein the locations are spaced apart to reduce cross-talk or interference between wires separated from each twisted pair.

10. The connector of claim 6, wherein the divider is in the form of a plastic block mounted on a printed circuit board.

11. The connector of claim 10, wherein the block includes apertures through which the contacts extend to provide electrical connection between the printed circuit board and the wires of the cable.

12. The connector of claim 10, wherein the printed circuit board carries a timing circuit for compensating cross-talk between wires of the cable.

13. A method of terminating a cable in a plug, comprising:

routing wires of twisted wire pairs into a divider of a plug and into a main channel of the divider, separating the twisted wire pairs from the cable at a plurality of branch points along the divider, wherein one of the branch points is located at a first axial position along the main channel and another of the branch points is located at a second axial position along the main channel spaced axially along the main channel from the first axial position, providing each of the twisted wire pairs along a pathway leading from one of the branch points of the divider, and separating the wires of each twisted wire pair and terminating the wires at contacts in the respective pathway.

14. The method of claim 13, wherein the method includes automatically trimming the wires as they are terminated.

15. The method of claim 13, wherein the method includes loading the termination assembly into a plug housing and over-molding the plug housing.

16. The method of claim 13, wherein the method includes molding a support boot onto the plug.

17. The method of claim 13, wherein the method includes loading the termination assembly into a plug housing and fitting a cap molding that terminates the wires when fitted to the plug housing.

* * * * *